US009130328B1

(12) United States Patent
Huang et al.

(10) Patent No.: US 9,130,328 B1
(45) Date of Patent: Sep. 8, 2015

(54) RF PASS-THROUGH CONNECTOR

(71) Applicant: INSERT ENTERPRISE CO., LTD., New Taipei (TW)

(72) Inventors: Tung-Liang Huang, New Taipei (TW); Sung-Wen Chen, New Taipei (TW)

(73) Assignee: Insert Enterprise Co., Ltd., New Taipei (TW)

( * ) Notice: Subject to any disclaimer, the term of this patent is extended or adjusted under 35 U.S.C. 154(b) by 0 days.

(21) Appl. No.: 14/290,536

(22) Filed: May 29, 2014

(30) Foreign Application Priority Data

Apr. 1, 2014 (TW) ..... 103205577

(51) Int. Cl.
*H01R 13/24* (2006.01)
*H01R 24/38* (2011.01)

(52) U.S. Cl.
CPC ..... *H01R 24/38* (2013.01); *H01R 13/2421* (2013.01)

(58) Field of Classification Search
CPC ..... H01R 13/2421
USPC ..... 439/700, 824
See application file for complete search history.

(56) References Cited

U.S. PATENT DOCUMENTS 2,858,518 A * 10/1958 Chrystie et al. ..... 439/426
3,275,970 A * 9/1966 Johanson et al. ..... 439/578
3,416,125 A * 12/1968 Theve ..... 439/638
4,740,746 A * 4/1988 Pollock et al. ..... 324/754.06
4,904,213 A * 2/1990 Hock et al. ..... 439/824
5,417,595 A * 5/1995 Cullen et al. ..... 439/700
5,681,187 A * 10/1997 Fukushima et al. ..... 439/700
5,879,198 A * 3/1999 Sekimori et al. ..... 439/700
6,053,777 A * 4/2000 Boyle ..... 439/700
6,146,210 A * 11/2000 Cha et al. ..... 439/680
6,305,969 B1 * 10/2001 Sato ..... 439/482
6,334,796 B1 * 1/2002 Fromme et al. ..... 439/700
6,910,911 B2 * 6/2005 Mellott et al. ..... 439/358
7,097,515 B2 * 8/2006 Siddiqi et al. ..... 439/700
7,556,529 B2 * 7/2009 Wakamatsu et al. ..... 439/578
7,708,607 B2 * 5/2010 Kuo et al. ..... 439/824
7,740,508 B2 * 6/2010 Feldman et al. ..... 439/700
7,946,892 B2 * 5/2011 Carboni et al. ..... 439/660
7,972,173 B1 * 7/2011 Hyzin et al. ..... 439/578
8,079,880 B2 * 12/2011 Lin et al. ..... 439/668
8,241,053 B2 * 8/2012 Slippy et al. ..... 439/353
8,272,903 B2 * 9/2012 Lin ..... 439/700
8,328,562 B1 * 12/2012 Rassoolkhani et al. ..... 439/34
8,469,731 B2 * 6/2013 Gloaguen et al. ..... 439/181
8,632,353 B2 * 1/2014 Rassoolkhani et al. ..... 439/358
8,641,446 B1 * 2/2014 Chen ..... 439/578
8,696,366 B2 * 4/2014 Chen et al. ..... 439/39
8,764,472 B2 * 7/2014 Rassoolkhani et al. ..... 439/347
8,905,795 B2 * 12/2014 Kim et al. ..... 439/700
8,986,039 B2 * 3/2015 Harlan et al. ..... 439/370
2008/0003852 A1 * 1/2008 Xu ..... 439/131
2010/0194419 A1 * 8/2010 Chan et al. ..... 324/761
2015/0072566 A1 * 3/2015 Hatch ..... 439/700

* cited by examiner

*Primary Examiner* — Ross Gushi
(74) *Attorney, Agent, or Firm* — Wang Law Firm, Inc.; Li K. Wang; Stephen Hsu

(57) ABSTRACT

A RF pass-through connector comprises at least a spring-loaded terminal comprised of a rod member and a sleeve member resiliently telescopically formed in a housing and adapted to be correspondingly contacted with a signal terminal formed in a socket and a receptacle cavity in the socket to be electrically connected with a grounding loop formed in a circuit board fixed in an electronic device, whereby upon a connection of the RF pass-through connector with the socket of the electronic device, a reliable, stable and efficient signal communication or transmission may be obtained through the terminals.

13 Claims, 11 Drawing Sheets

RF PASS-THROUGH CONNECTOR

RELATED APPLICATION

This application claims the benefit of a Taiwanese patent application, 103205577, filed on Apr. 1, 2014, the specification of which is incorporated here by this reference.

BACKGROUND OF THE INVENTION

A conventional RF (Radio Frequency) connector is provided to externally connect a radio frequency antenna or signal sources from an electronic device, such as: a notebook computer, flat computer (iPad), portable electronic device, or vehicle multi-media communication devices, to enhance the capability for receiving radio frequency signals.

Such a conventional method for receiving radio frequency signals may mate a terminal in the conventional RF connector with another terminal in a socket fixed in the electronic device for signal transmission or communication through the RF connector in between the externally connected antenna and the electronic device. The contact terminal in the RF connector should be kept in a close contact with the signal terminal in the socket of the electronic device in order to complete a well signal connection therebetween. After a long time use, the contact between the RF connector and the socket in electronic device may however be loosened, weakened, or even disconnected due to the following reasons:

1. After long-time service, the contacting pressure between the two mating terminals may be weakened, to loosen their contacting and attenuate their signal transmission.
2. The dust or dirts may be accumulated in between the mating terminals to thereby block or disconnect their signal transmission or communication.
3. The vibration, shaking or movements of the related systematic equipments may deviate the locations of the terminals to affect their contacting and the signal transmission efficiency.

The present inventor has found the drawbacks of a conventional RF connector and invented the present spring-loaded RF connector for an easy assembly and a stable connection.

SUMMARY OF THE INVENTION

The object of the present invention is to provide a RF pass-through connector including at least a spring-loaded terminal comprised of a rod member and a sleeve member resiliently telescopically formed in a housing and adapted to be correspondingly connected with a signal terminal formed in a socket and a receptacle cavity in the socket to be electrically connected with a grounding loop formed in a circuit board fixed in an electronic device, whereby upon a connection of the RF pass-through connector with the socket of the electronic device, a reliable, stable and efficient signal communication or transmission may be obtained through the terminals.

DETAILED DESCRIPTION

Figure 1:
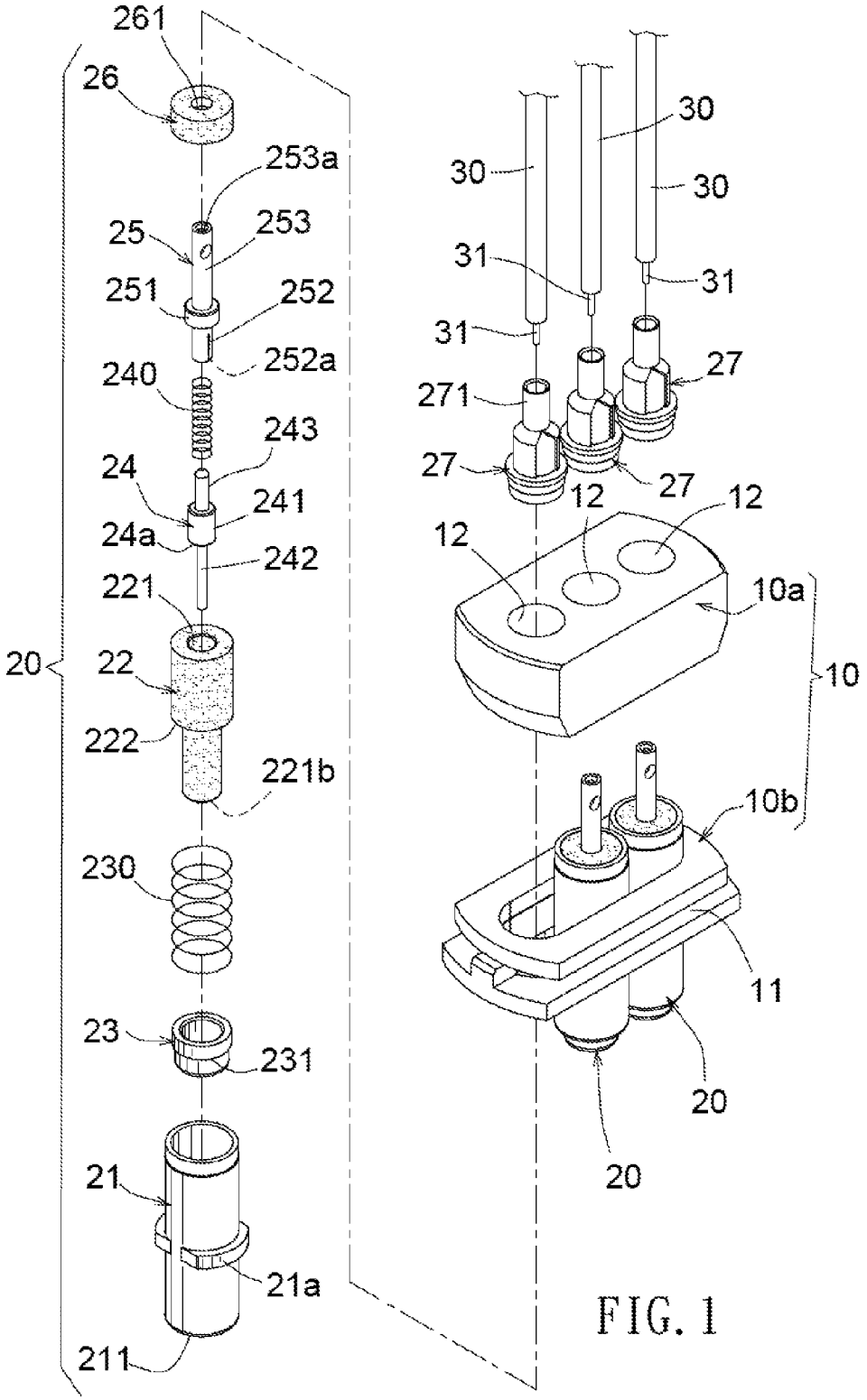
FIG. 1 is an exploded view showing the elements of the present invention.

As shown in FIGS. 1-6, the RF (Radio Frequency) pass-through connector of the present invention comprises: a housing 10, and at least a spring-loaded terminal 20 fixed in the housing 10.

The spring-loaded terminal 20 includes: a sleeve member 23 and a rod member 24 resiliently telescopically retained in the terminal 20 within the housing 10 to be respectively contacted with a cavity 411 in a socket body 41 to be electrically connected with a grounding path and contacted with a signal terminal 42 in the socket body 41 of a socket 40 mounted on a circuit board formed in (or attached to) an electronic device. The socket body 41 is electrically connected with the grounding path or loop of the circuit board formed in the electronic device for grounding and eliminating noise formed during the signal transmission or communication through the RF connector of the present invention and the socket 40. The socket body 41 is made of metallic materials for a nice grounding.

The RF connector of the present invention may be applied in rugged electronic devices including: industrial computer, flat computer, portable electronic devices, notebook computer, etc. The RF connector may be provided in between the electronic device and a signal source or an antenna; or in between two electronic devices for a quick reliable connection and signal transmission therebetween or for a quick disconnection when needed. So, a nice connection with signal sources, such as: Wi-Fi, GPS, 3G, audio video multi-media, can be effected by the present invention for a reliable and quick signal transmission or communication.

Figure 2:
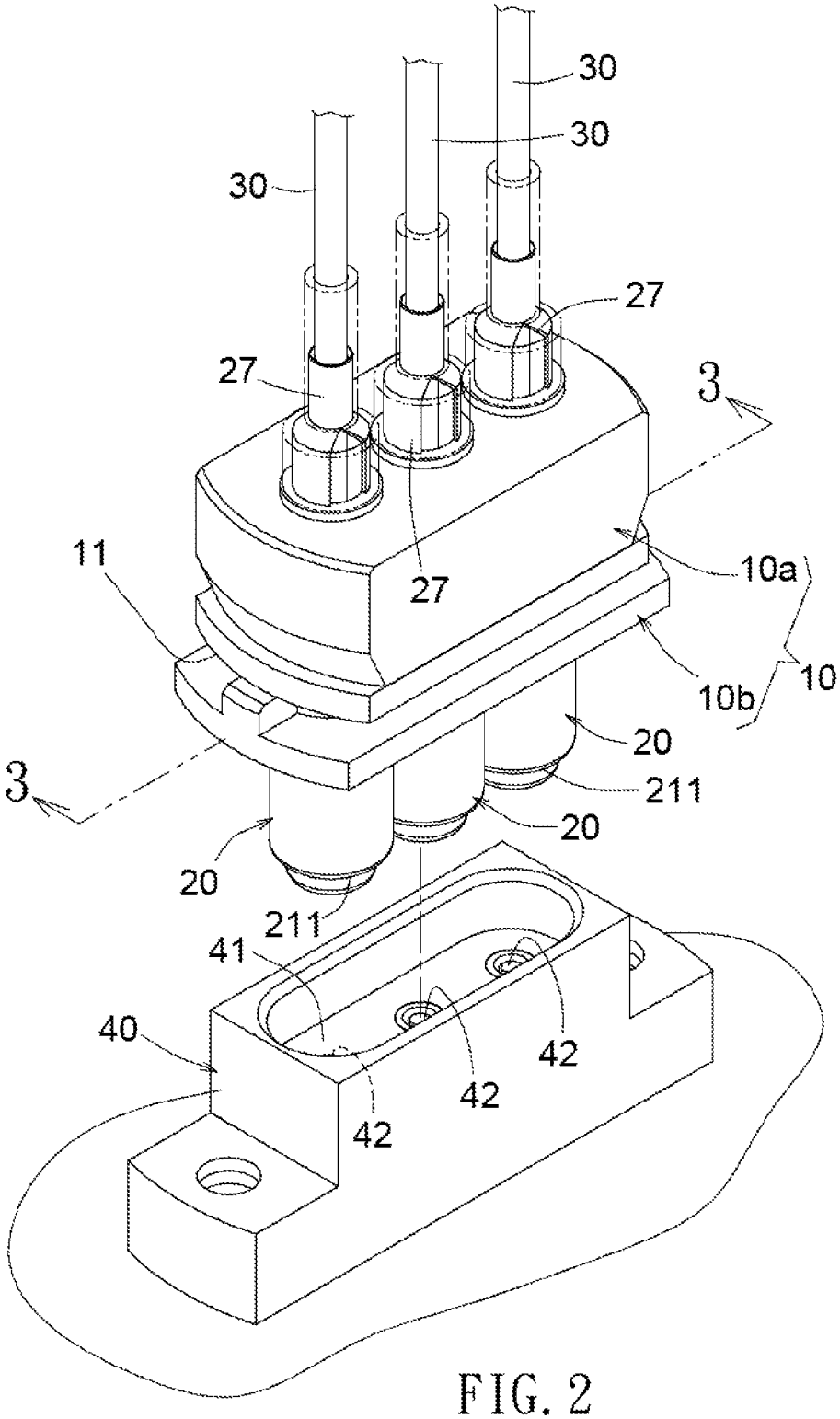
FIG. 2 is a perspective view showing the present invention before being assembled.

As shown in FIGS. 1 and 2, the housing 10 of the present invention includes a metal shell 10*a* and a plastic shell 10*b* combined to each other. A groove 11 is recessed in the plastic shell 10*b* adapted for embedding a fixture, such as formed on an outlet of an electronic device, for fixing the RF connector.

Figure 3:
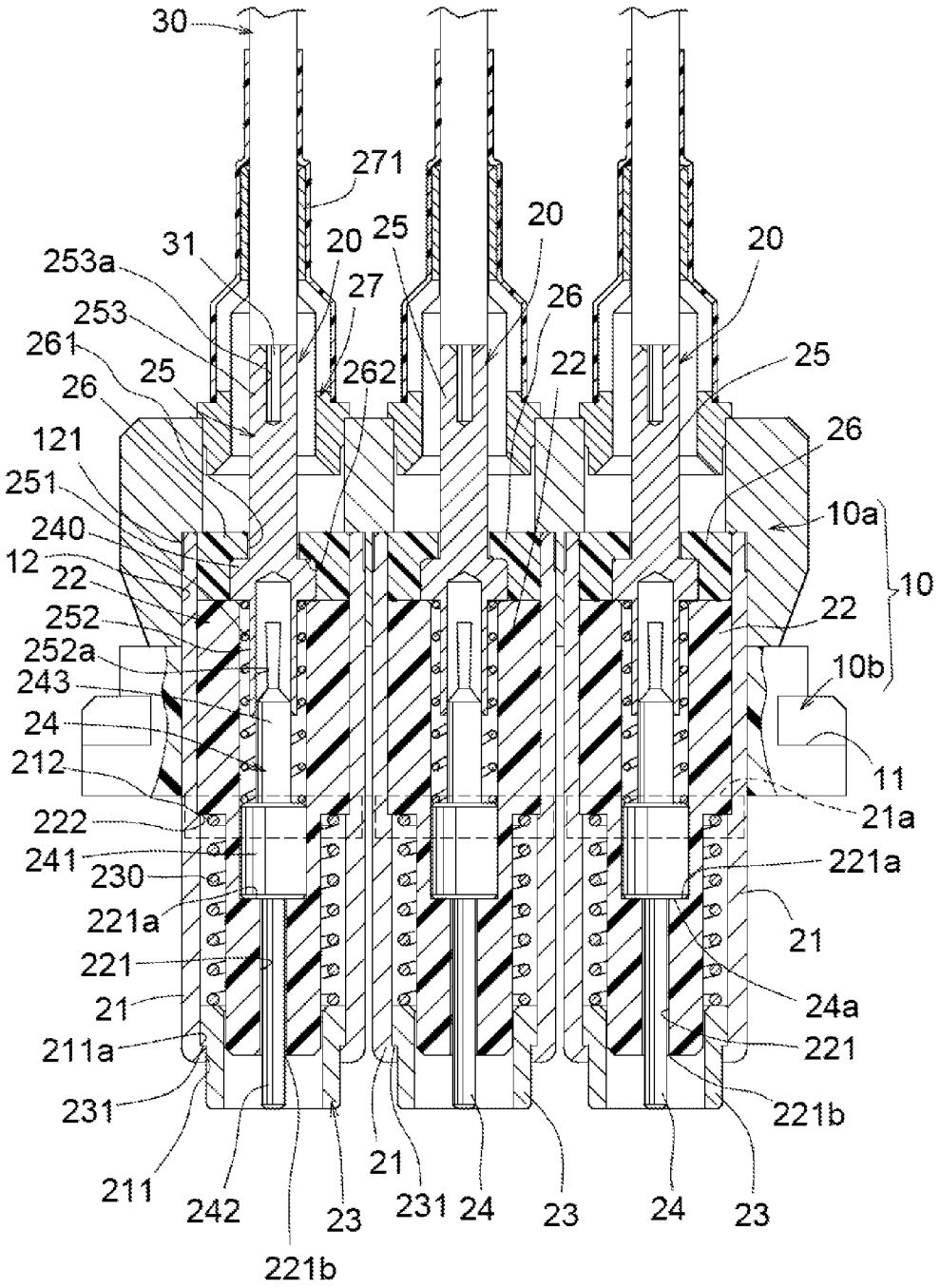
FIG. 3 is a sectional drawing of the present invention as taken from Line 3-3 of FIG. 2.

As shown in FIGS. 1 and 3, the housing 10 includes a plurality of terminal holes 12 each for inserting each spring-loaded terminal 20 therein. Each terminal hole 12 includes a shoulder portion 121 for limiting a stopping member 26 of the terminal 20.

As shown in FIG. 3, the RF connector of the present invention is a triple-port RF connector, having three terminals 20 adapted for connecting three signal cables 30.

Figure 7:
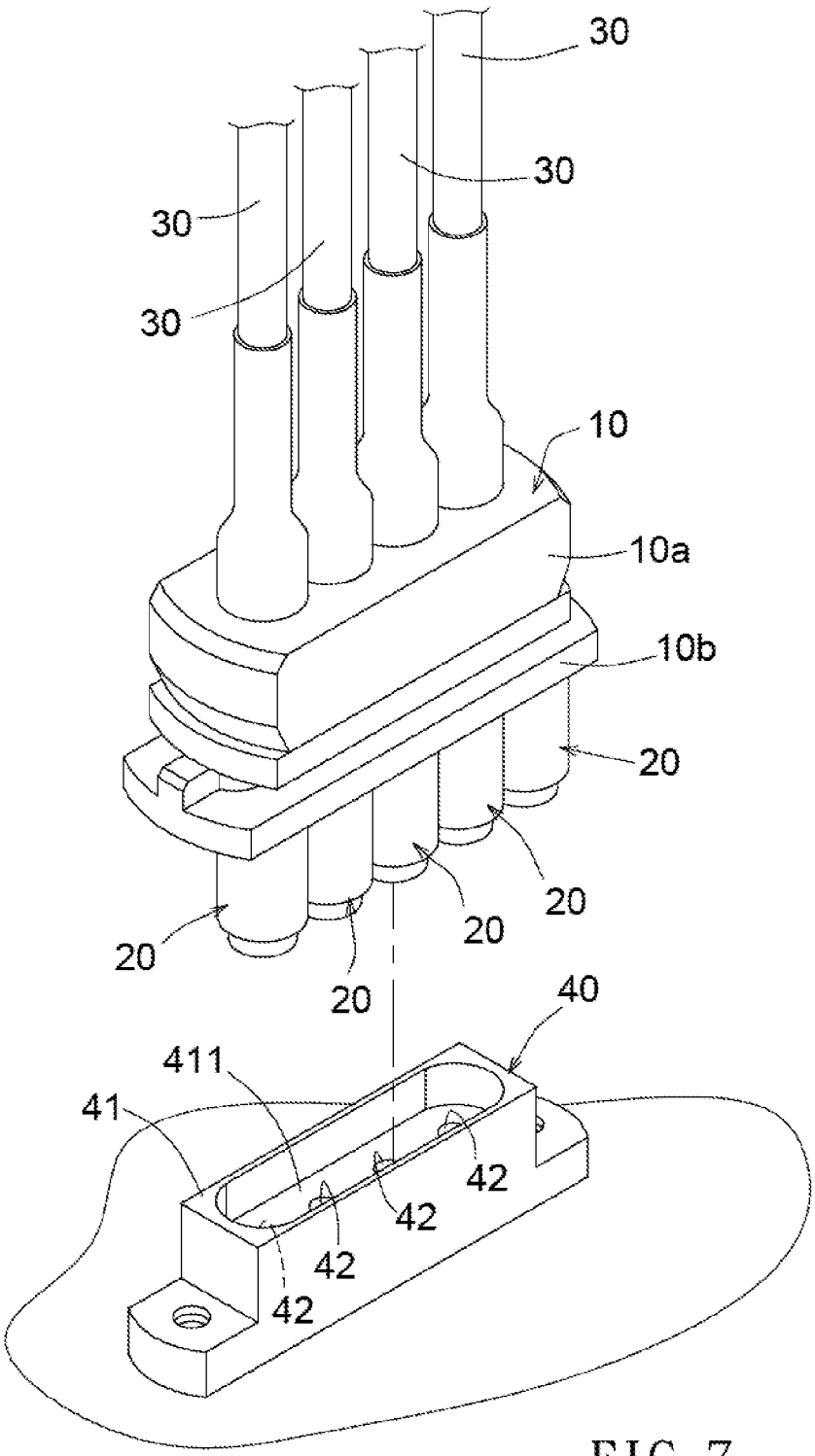
FIG. 7 is an illustration showing a quadruple-port RF connector in accordance with the present invention.

As shown in FIG. 7, it is a quadruple-port RF connector including four terminals 20 connected with four signal cables 30.

Figure 8:
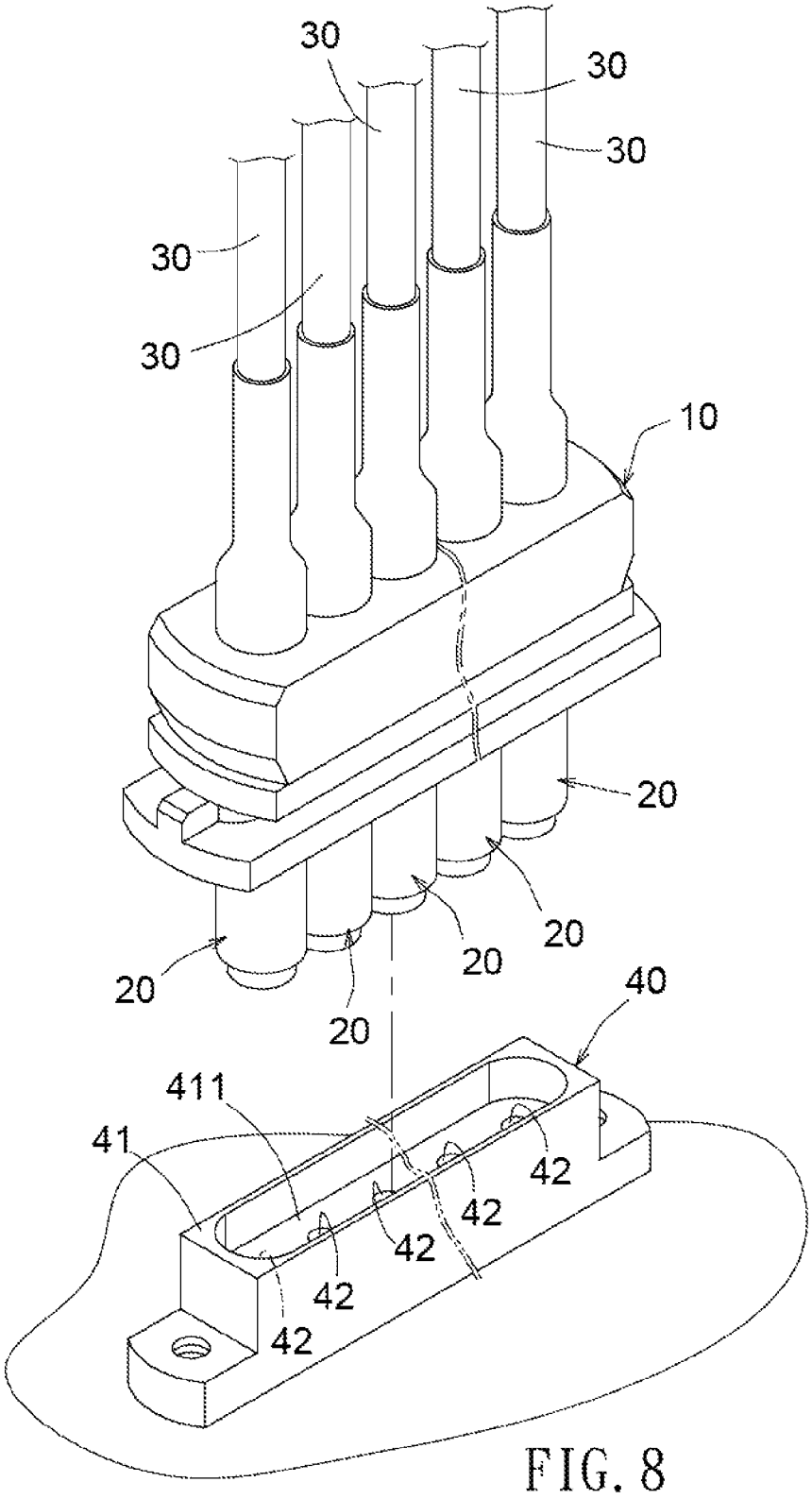
FIG. 8 shows a penta-port RF connector of the present invention.

While the embodiment as shown in FIG. 8, it is a penta-port RF connector having five terminals 20 with five cables 30.

Such plural-port connector is connected with the corresponding socket 40 formed in a circuit board of an electronic device. The number of ports, terminals 20 and cables 30 are not limited in the present invention in order to be suitable for rapidly developing systems of multiple signal sources, such as: Wi-Fi, GPS, 3G, 5G, etc.

As shown in FIGS. 1 and 3, the spring-loaded terminal 20 includes: an outer cylinder 21 embedded in a terminal hole 12 formed through the housing 10 and having a fixed end engaged with a limiting shoulder portion 121 formed in the terminal hole 12 and having a bottom opening 211 formed in a free bottom end of the cylinder 21; an insulating member 22 embedded in the outer cylinder 21 and having a sliding cavity 221 formed through the insulating member 22; a sleeve member 23 slidably held in the outer cylinder 21 adjacent to the free bottom end of the cylinder 21 and resiliently urged outwardly or downwardly beyond the bottom opening 211 by an outer spring 230 retained between the insulating member 22 and the sleeve member 23 to be resiliently electrically contacted with a cavity 411 of the socket body 41 to be electrically connected with a grounding path or grounding loop formed in a circuit board, upon which the socket body 41 is mounted; a rod member 24 slidably held in the sliding cavity 221 of the insulating member 22 and resiliently urged outwardly or downwardly beyond the bottom opening 211 by an inner spring 240 to be resiliently electrically contacted with a signal terminal 42 formed in the corresponding socket 40; a wire-clamping member 25 connected to a signal cable 30 which is connectable to an external signal source or an additional RF connector (not shown); the inner spring 240 retained between the rod member 24 and the wire-clamping member 25; a stopping member 26 packed between the wire-clamping member 25 and the limiting shoulder portion 121 in the terminal hole 12 of the housing 10 for limiting the wire-clamping member 25 within the housing 10; and a cable fastener 27 fixed on the housing 10 for fastening the signal cable 30 led to the spring-loaded terminal 20 as embedded in the housing 10.

The outer cylinder 21 has a flange 21*a* partially circumferentially formed on the cylinder 21 to "clamp" or fasten the metal shell 10*a* and the plastic shall 10*b* by the aid of the cable fastener 27, thereby firmly combining the metal shell 10*a* and the plastic shell 10*b* of the housing 10 as fastened between the fastener 27 and the flange 21*a* (as dotted line shown in FIG. 3).

The outer cylinder 21 has a bottom rim 211*a* centripetally bent inwardly along the bottom opening 211 for limiting an annular extension 231 circumferentially formed on an inner (or upper) portion of the sleeve member 23 for preventing an outward or downward releasing of the sleeve member 23 from the bottom opening 211 of the outer cylinder 21.

The insulating member 22 includes an annular shoulder portion 222 engageable with an annular seat portion 212 formed in the outer cylinder 21 for limiting an outward or downward releasing of the insulating member 22 from the bottom opening 211 of the outer cylinder 21 (FIG. 3).

The rod member 24 includes an annular bottom portion 24*a* formed on a bottom of a rod portion 241 to be outwardly or downwardly limited by an annular seat portion 221*a* formed in the sliding cavity 221 of the insulating member 22 for preventing an outward or downward releasing of the rod member 24 from a bottom opening 221*b* of the insulating member 22.

Figure 5:
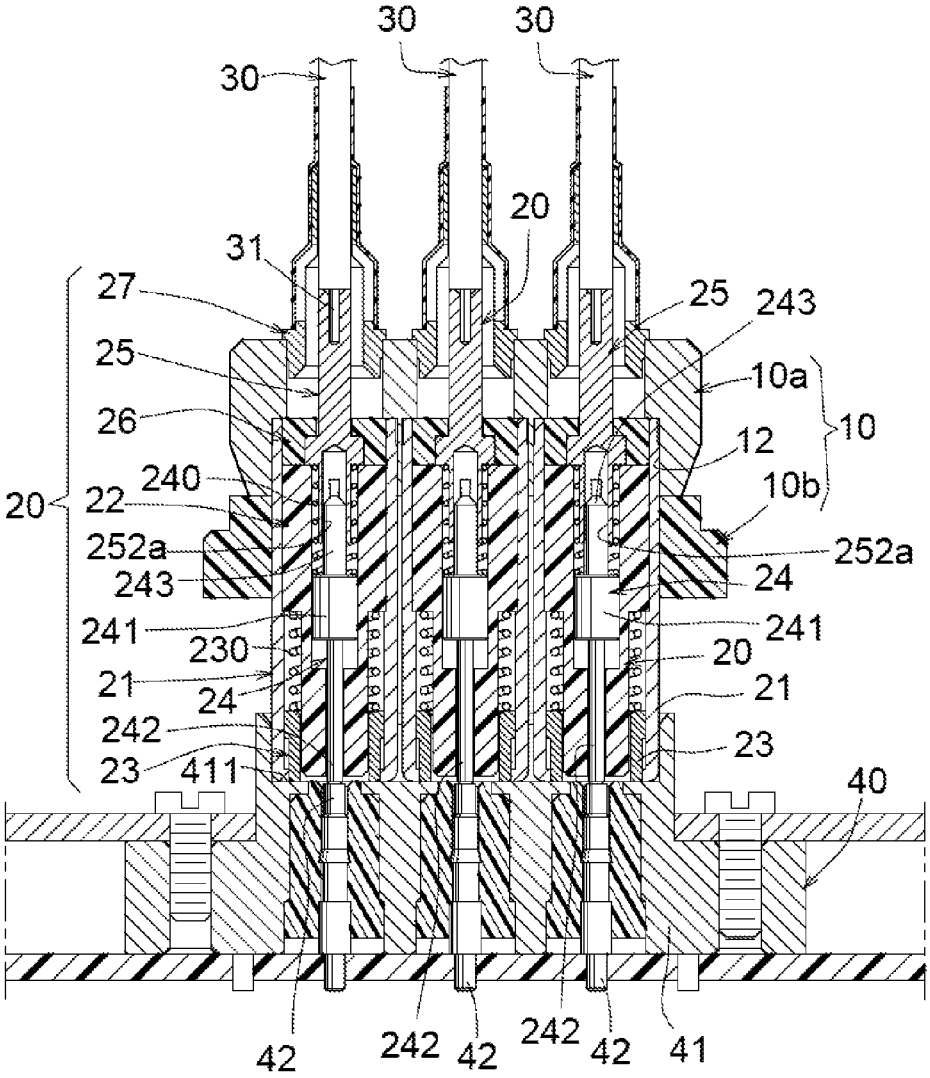
FIG. 5 shows a complete insertion of the RF connector into the socket.

As shown in FIGS. 1, 3 and 5, the rod member 24 includes: a rod portion 241, a contact pin 242 axially formed on a first end of the rod portion 241 to be resiliently contacted with the signal terminal 42 formed in the corresponding socket 40; and an engaging pin 243 axially formed on a second end of the rod portion 241, opposite to the contact pin 242, to be slidably engaged with a chuck 252*a* formed in a pin sheath 252 of the wire-clamping member 25.

The wire-clamping member 25 includes: a disk portion 251 retained between the insulating member 22 and a stopping member 26 embedded on a limiting shoulder portion 121 in the housing 10, a pin sheath 252 axially formed on a first end of the disk portion 251 to be slidably engaged with the engaging pin 243 of the rod member 24 (FIG. 3), and a wire sheath 253 axially formed on a second end of the disk portion 251 to be connected with a stripped wire 31 of the signal cable 30.

The pin sheath 252 of the wire-clamping member 25 includes a chuck 252*a* for resiliently clamping the engaging pin 243 of the rod member 25; while the wire sheath 253 is formed with a wire hole 253*a* for fastening the stripped wire 31 in the wire hole 253*a* for firmly fastening the signal cable 30.

The stopping member 26 includes a central hole 261 formed through the stopping member 26 for protruding the wire sheath 253 outwardly to be connected with the signal cable 30, and a disk hole 262 communicated with the central hole 261 for engaging the disk portion 251 in the disk hole 262; with the stopping member 26 disposed within the outer cylinder 21 and stably embedded on the shoulder portion 121 in the housing 10.

The cable fastener 27 is plugged in the terminal hole 12 of the housing 10, having a crimping tube 271 for fastening the signal cable 30 therein. The cable fastener 27 and the flange 21*a* of the outer cylinder 21 will cooperatively fasten the housing 10 therebetween, so that the elements of the present invention will be stably confined, engaged, embedded or packed with one another within the housing 10, the cylinder 21 and the fastener 27, and all the elements will be easily assembled, without the aid of adhesive, to form the RF connector of the present invention for simplifying the assembly, reducing the production cost and preventing environmental pollution (as no adhesive used).

The socket 40 includes: a socket body 41 having a receptacle cavity 411 recessed therein and made of metallic materials, and secured on a circuit board, and electrically connected with a grounding loop or path formed on the circuit board, and a plurality of signal terminals 42 each formed in the receptacle cavity 411 to be mated or contacted with a corresponding rod member 24 of the spring-loaded terminal 20 for signal transmission or communication therethrough. The socket body 41 may be integrally formed by mechanical processing or casting process to render its high strength, high precision and low wearing.

Figure 4:
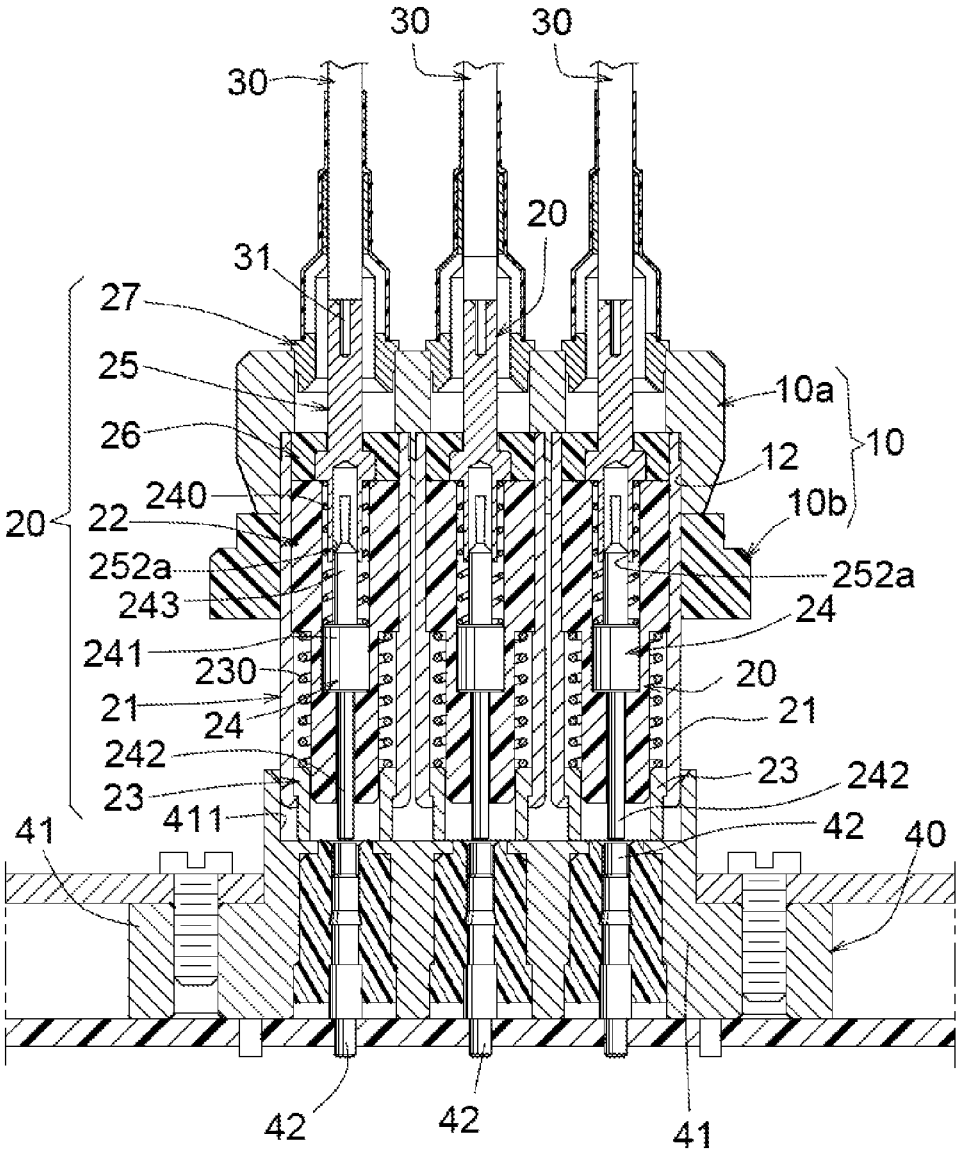
FIG. 4 is a sectional drawing when the RF connector is inserted (not completely) into the socket.

When using the RF connector of the present invention, the spring-loaded terminals 20 are plugged into the receptacle cavity 411 of the corresponding socket 40 (FIGS. 2, 4 and 5). The sleeve member 23 is downwardly (or outwardly) urged by the outer spring 230 to be resiliently contacted with the receptacle cavity 411 of the corresponding socket 40 to be electrically connected with a grounding path or loop (or grounding circuit) formed on a circuit board having the socket 40 mounted thereon for eliminating the noise emitted during the signal transmission.

Meanwhile, the rod member 24 is also downwardly (or outwardly) urged by the inner spring 240 to be resiliently contacted with the signal terminal 42 in the socket 40 to electrically connect the spring loaded terminal 20 of the RF connector with the signal terminal 42 of the socket 40 to thereby complete a signal transmission path or system for receiving (or transmitting) the signal from an externally connected antenna (or signal source) or an additional electronic device (not shown) as passing through the RF connector of the present invention.

Figure 6:
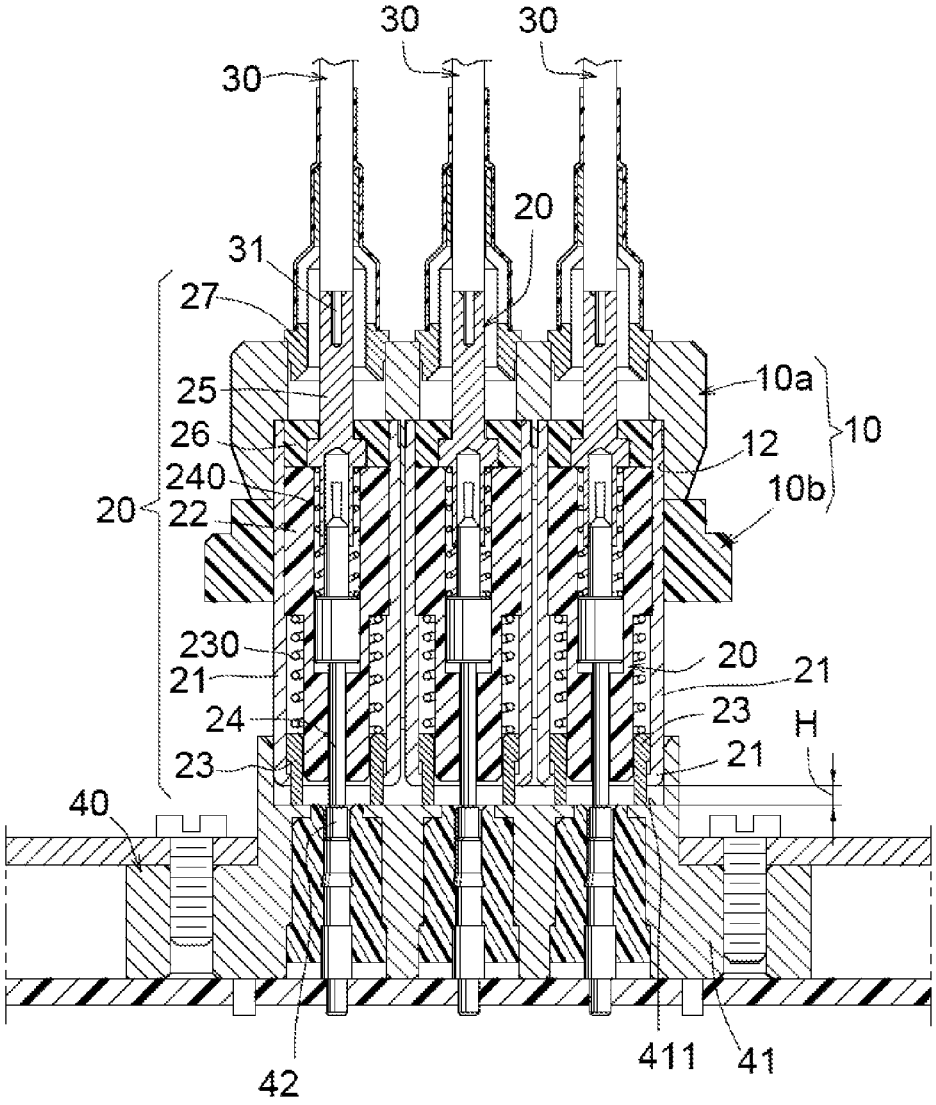
FIG. 6 shows a distance (H) which remains before a complete insertion of the RF connector into the socket.

Even the RF connector of the present invention is not precisely inserted into the socket 40 as shown in FIG. 6, such as remaining a distance H between the terminal bottom of the RF connector and the surface of the receptacle cavity 411 of the socket 40, the outer spring 230 and the inner spring 240 will still urge the sleeve member 23 and the rod member 24 (namely, the contact pin 242) downwardly to be resiliently contacted with the receptacle cavity 411 and the signal terminal 42 of the socket 40, thereby automatically compensatively manipulating a well contact between the RF connector and the socket 40 for ensuring a reliable signal transmission or communication therebetween, and enhancing a better elimination of noise as produced in the signal transmission system.

Figure 9:
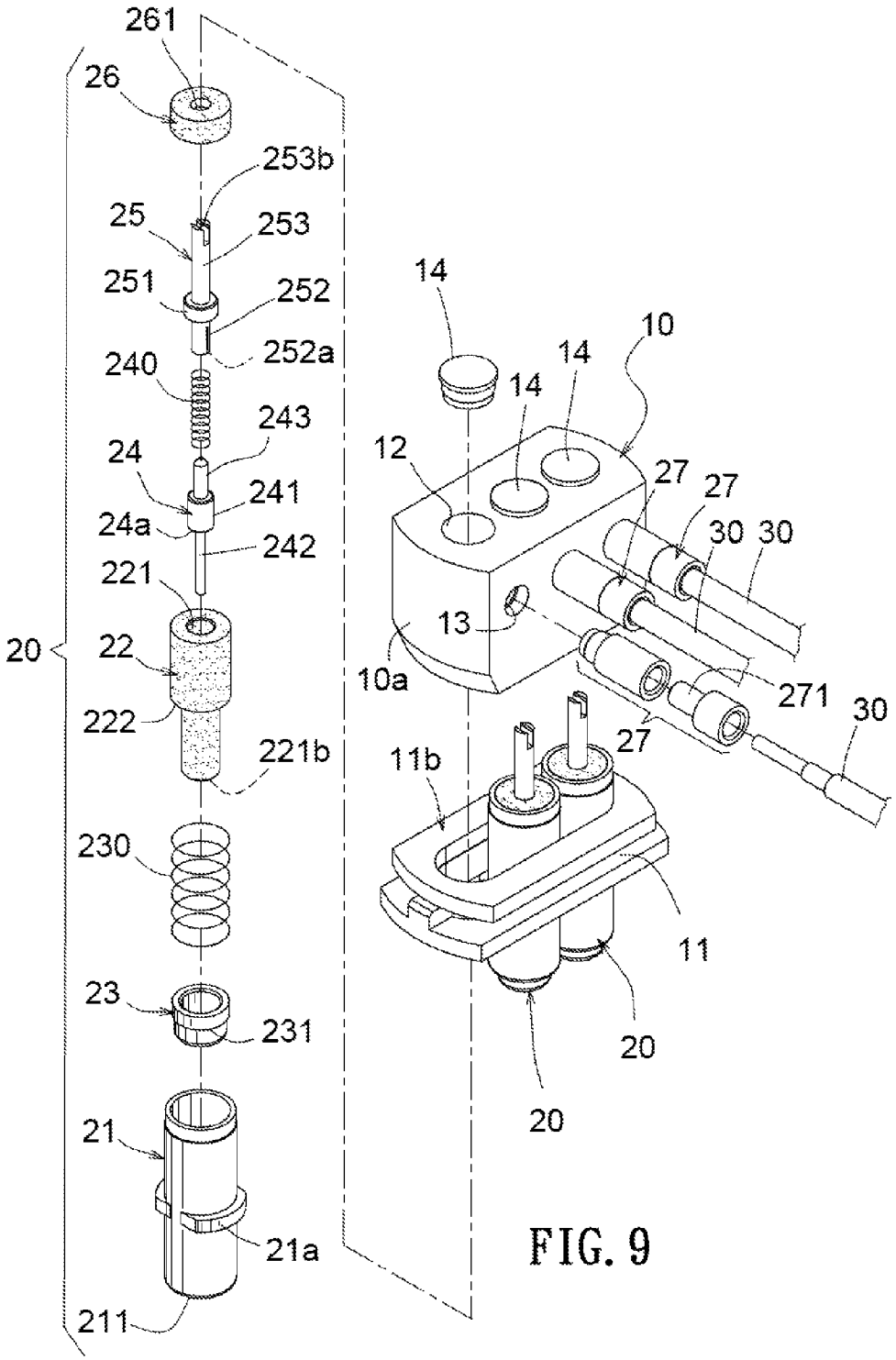
FIG. 9 is an exploded viewed of an angled RF connector of the present invention.
Figure 10:
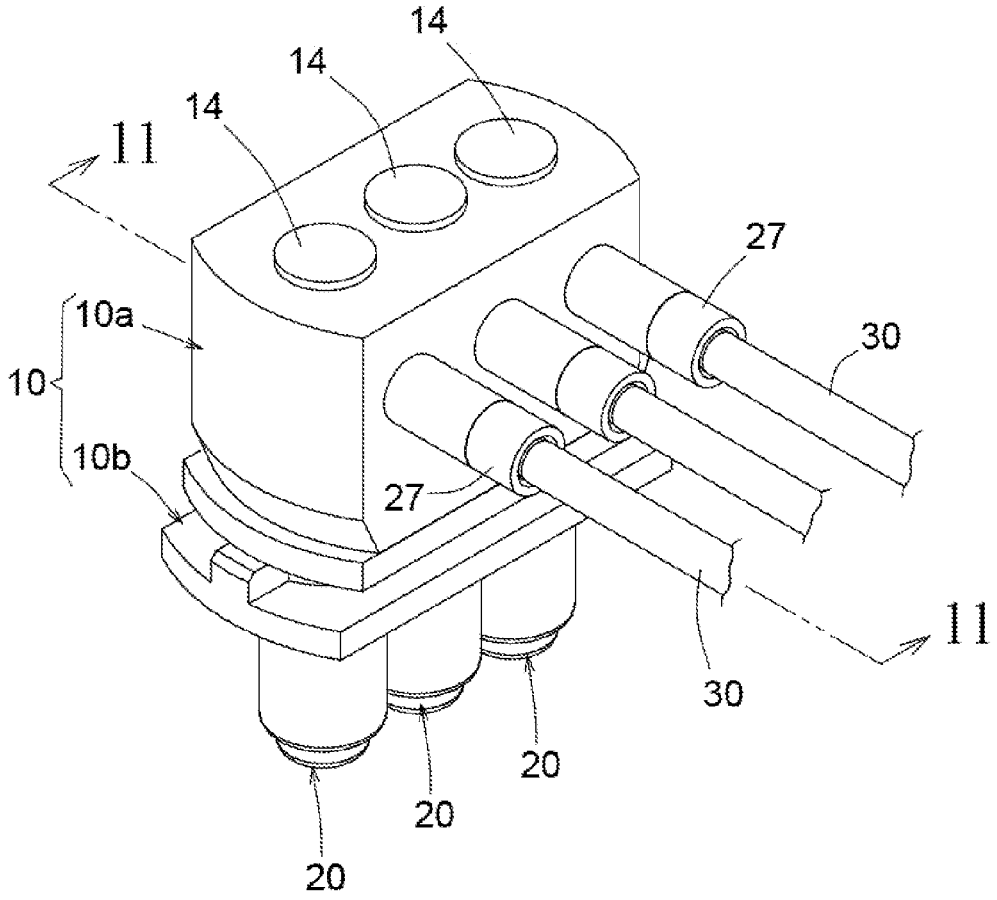
FIG. 10 is a perspective view of the connector as assembled from FIG. 9.
Figure 11:
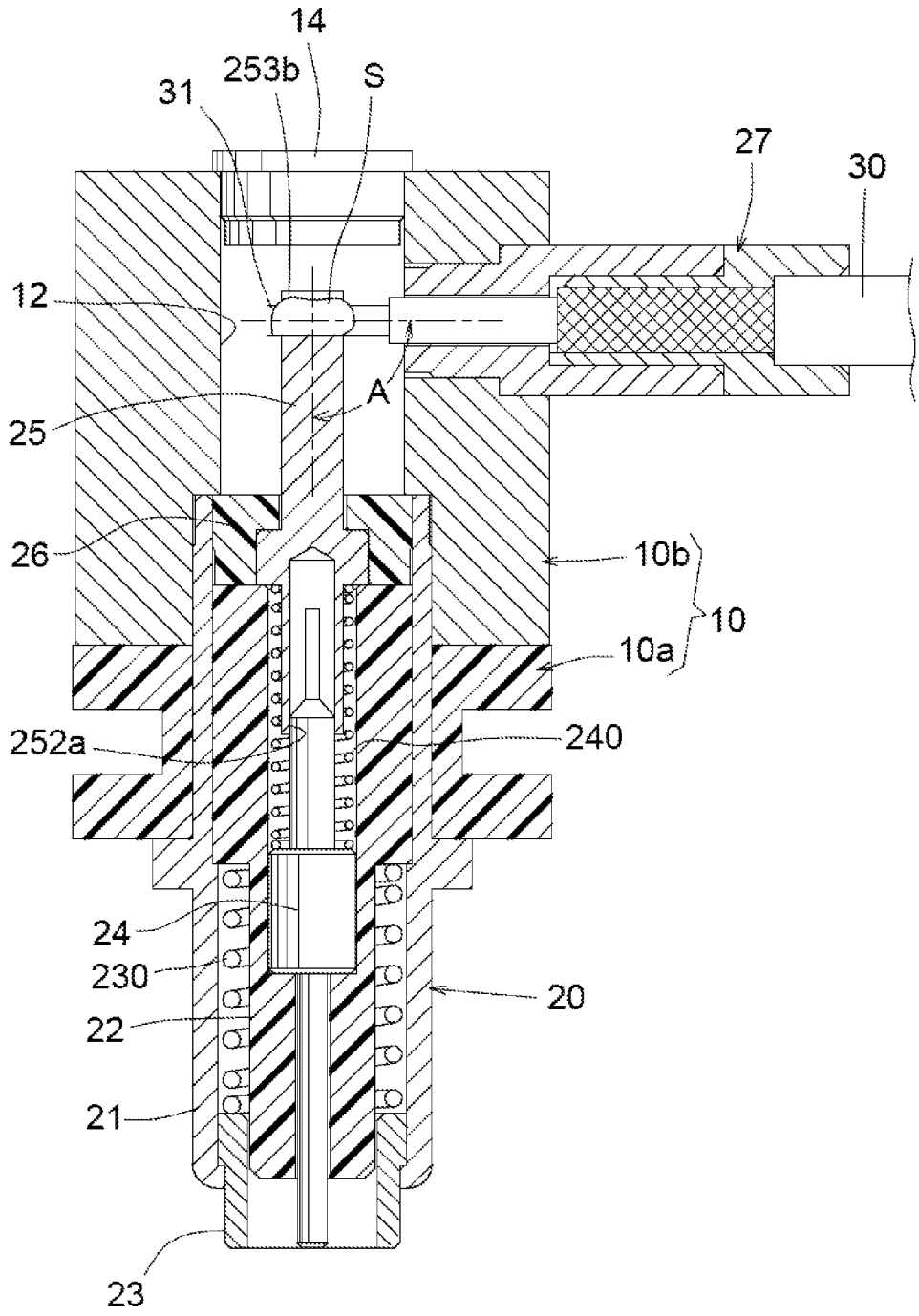
FIG. 11 is a sectional drawing as viewed from Line 11-11 of FIG. 10.

As shown in FIGS. 9-11, another preferred embodiment of the present invention is disclosed by modifying the aforementioned RF connector to be an angled RF connector, namely, by separating (or defining) the signal cable 30 and the cable fastener 27 with an angle A, which may be a right angle or any other degrees as required, not limited in the present invention.

The wire 31 is angularly connected with a wire slot 253*b* formed in a top or an end portion of the wire-clamping member 25 by soldering S (FIG. 11) through a top or end opening of the terminal hole 12 which is covered by a cover 14 for dust proof. The wire 31 of the cable 30 is fastened by fastener 27 by passing through a side hole 13 formed in a side portion of the shell 10*a* of housing 10.

The present invention may be further modified without departing from the spirit and scope of the present invention.

The present invention has the following advantages superior to the conventional RF connector:

1. Since the rod member 24 and the sleeve member 23 are respectively urged downwardly or outwardly by an inner spring 240 and an outer spring 230, the contact pin 242 of the rod member 24 will be resiliently contacted with the signal terminal 42 in the socket 40 to ensure a close contact between the terminals 42, 20 for a reliable signal transmission therethrough, and the sleeve member 23 will be resiliently forced upon the surface of the receptacle cavity 411 of the socket 40 for a well grounding through a grounding path or loop formed in a circuit board, upon which the socket 40 is mounted, for eliminating noise, without interfering the signal transmission quality.
2. The inner and outer springs 240, 230 may serve as dampers for buffering excess stress as caused between the two terminals 20, 42. Since each spring 240 or 230 is retractable, compressible or telescopic, an over-pressure contacting between the terminals 20, 42 can be prevented. Also, the springs 240, 230 may absorb any vibrational shock caused when the electronic device with the signal communication system is vibrated, shaked, or moved, thereby ensuring a reliable signal connection or transmission between the terminals 20, 42.
3. The sleeve member 23 is circumferentially disposed around the contact pin 242 of the rod member 24 and downwardly resiliently forced to well "seal" the surface of the receptacle cavity 411 of the socket 40, thereby serving like a "dust cover (or shield)" for preventing dust or dirt accumulation in the interface between the terminal pin 242 ad the terminal 42, thereby rendering best dust-proof function in order for a reliable signal transmission.
4. All elements are embedded, engaged, packed or retained with one another within the housing 10 so that no adhesive is required for bonding or binding the related elements for simplifying the assembly, reducing the production cost and preventing environmental pollution (because of no use of chemical adhesive).

Either spring 230,240 is preferably made of helical spring, but not limited in this invention.

The invention claimed is:

1. A radio frequency (RF) connector comprising:

a housing having at least a terminal hole formed through the housing; and at least a spring-loaded terminal resiliently telescopically held in said terminal hole in said housing and outwardly resiliently urged to be contacted with a signal terminal formed in a socket mounted on a circuit board of an electronic device;

said spring-loaded terminal connected with at least a signal cable externally connected with a signal source including an antenna or an additional electronic device;

whereby upon mating of said spring-loaded terminal in said RF connector with said signal terminal in said socket, a signal is reliably transmitted between said signal source and said electronic device connected with said RF connector; and said spring-loaded terminal including:

an outer cylinder embedded in said terminal hole formed through the housing and having a fixed end engaged with a limiting shoulder portion formed in the terminal hole and having a bottom opening formed in a free bottom end of the cylinder; an insulating member embedded in the outer cylinder and having a sliding cavity formed through the insulating member;

a sleeve member slidably held in the outer cylinder adjacent to the free bottom end of the cylinder and resiliently urged outwardly beyond the bottom opening by an outer spring retained between the insulating member and the sleeve member to be resiliently electrically contacted with a cavity of a socket body of said socket to be electrically connected with a grounding path or loop formed in a circuit board, upon which the socket body is mounted;

a rod member slidably held in the sliding cavity of the insulating member and resiliently urged outwardly beyond the bottom opening by an inner spring to be resiliently electrically contacted with said signal terminal formed in the socket;

a wire-clamping member connected to said signal cable which is connectable to said signal source;

the inner spring retained between the rod member and the wire-clamping member;

a stopping member packed between the wire-clamping member and the limiting shoulder portion in the terminal hole of the housing for limiting the wire-clamping member within the housing; and a cable fastener fixed on the housing for fastening the signal cable led to the spring-loaded terminal as embedded in the housing.

2. A RF connector according to claim 1, wherein said housing, having said outer cylinder of said spring-loaded terminal held in said housing, includes a metal shell and a plastic shell combined to each other; having a groove recessed in the plastic shell adapted for embedding a fixture for fixing the RF connector.

3. A RF connector according to claim 2, wherein said outer cylinder has a flange partially circumferentially formed on the cylinder to cooperatively fasten the metal shell and the plastic shall with a cable fastener fixed in said housing for firmly combining the metal shell and the plastic shell of the housing.

4. A RF connector according to claim 1, wherein said outer cylinder has a bottom rim centripetally bent inwardly along the bottom opening for limiting an annular extension circumferentially formed on an inner portion of the sleeve member for preventing an outward releasing of the sleeve member from the bottom opening of the outer cylinder.

5. A RF connector according to claim 1, wherein said insulating member includes an annular shoulder portion engageable with an annular seat portion formed in the outer cylinder for limiting an outward releasing of the insulating member from the bottom opening of the outer cylinder.

6. A RF connector according to claim 1, wherein said rod member includes an annular bottom portion formed on a bottom of a rod portion to be outwardly limited by an annular seat portion formed in the sliding cavity of the insulating member for preventing an outward releasing of the rod member from a bottom opening of the insulating member.

7. A RF connector according to claim 1, wherein said rod member includes: a rod portion, a contact pin axially formed on a first end of the rod portion to be resiliently contacted with the signal terminal formed in the corresponding socket; and an engaging pin axially formed on a second end of the rod portion, opposite to the contact pin, to be slidably engaged with a chuck formed in a pin sheath of the wire-clamping member.

8. A RF connector according to claim 1, wherein said wire-clamping member includes: a disk portion retained between the insulating member and said stopping member embedded on a limiting shoulder portion in the housing, a pin sheath axially formed on a first end of the disk portion to be slidably engaged with the engaging pin of the rod member, and a wire sheath axially formed on a second end of the disk portion to be connected with a stripped wire of the signal cable.

9. A RF connector according to claim 8, wherein said pin sheath of the wire-clamping member includes a chuck for resiliently clamping the engaging pin of the rod member; and the wire sheath formed with a wire hole therein for fastening the stripped wire in the wire hole for firmly fastening the signal cable.

10. A RF connector according to claim 8, wherein said stopping member includes a central hole formed through the stopping member for protruding the wire sheath outwardly to be connected with the signal cable, and a disk hole communicated with the central hole for engaging the disk portion in the disk hole; with the stopping member disposed within an outer cylinder in said housing and stably embedded on the shoulder portion in the housing.

11. A RF connector according to claim 1, wherein said cable fastener, as plugged in the terminal hole of the housing, includes a crimping tube for fastening the signal cable therein.

12. A RF connector according to claim 1, wherein said wire-clamping member is angularly connected with said signal cable by defining an angle between said wire-clamping member and said signal cable.

13. A RF connector according to claim 1, wherein each of said inner spring and said outer spring is made of a helical spring.

* * * * *